US005139052A

United States Patent [19]

Derudder

[11] Patent Number: 5,139,052

[45] Date of Patent: Aug. 18, 1992

[54] TACKLE SUSPENSION FOR A JACQUARD MACHINE

[75] Inventor: Carlos Derudder, Kortrijk/Heule, Belgium

[73] Assignee: N.V. Michel Van de Wiele, Kortrijk/Marke, Belgium

[21] Appl. No.: 707,067

[22] Filed: May 29, 1991

[30] Foreign Application Priority Data

May 31, 1990 [BE] Belgium ..... 9000599

[51] Int. Cl.[5] ..... D03C 3/00

[52] U.S. Cl. ..... 139/65; 139/21; 254/396

[58] Field of Search ..... 139/21, 65, 59; 254/394, 395, 396

[56] References Cited

U.S. PATENT DOCUMENTS 4,530,382 7/1985 Schleicher ..... 139/65 X
5,038,837 8/1991 Palau et al. ..... 139/65

FOREIGN PATENT DOCUMENTS 529019 6/1954 Belgium .
548296 6/1956 Belgium .
2939714 10/1980 Fed. Rep. of Germany .
6440630 2/1989 Japan ..... 139/65
883257 11/1961 United Kingdom .

*Primary Examiner*—Andrew M. Falik
*Attorney, Agent, or Firm*—James Creighton Wray

[57] ABSTRACT

A pulley arrangement for a Jacquard machine, in which for at least every two picks, three positions can be created for the warp threads is made up of two pulley elements (14) and (17) hanging above one another and suspended below each set of two complimentary hooks (11), (12). Pulley cord (13) is fixed by each end to one of the hooks (11), (12), with the downward-hanging part running over the top roller (14') of pulley element (14). Pulley cord (15) is suspended from one hook (11) and runs with the downward-hanging part over the top roller (17') of pulley element (17). It is passed upward over the bottom roller (14'') and is fixed by the end to fixed and controllable grid (16). Pulley cord (18) is guided over the bottom roller (17'') of pulley element (17), fixed by one end to fixed or controllable grid (19) and is connected by the other end to at least one warp thread.

8 Claims, 9 Drawing Sheets h
h/2
T
M
B

TACKLE SUSPENSION FOR A JACQUARD MACHINE

BACKGROUND OF THE INVENTION

The subject of the invention described below is a device for a Jacquard machine for lifting the pile warp threads into one of three possible positions for the purpose of forming the shed in a face-to-face weaving machine, and this for each weft insertion. This invention relates more particularly to a device which, connected at one side to the hooks and at the other to one or more of the warp threads, can achieve three possible positions of the warp threads connected thereto.

A Jacquard machine of the known type is in fact provided with at least one arrangement of two complementary rows of hooks, in which in a first possibility each hook—depending on the complementary row to which it belongs—can be carried along by one of two knives moving up and down in opposite phase, and can move along with the up and down moving knife on which it rests with a projecting part, or in a second possibility can be held by means of known selection mechanisms in its top or its bottom position—depending on the design of the Jacquard machine—while the knife carries out the normal up and down movement. Two hooks situated directly opposite each other and belonging to a different complementary row form a so-called complementary hook set, each either moving with their respective knives in opposite phase to each other, or of which one hook—or both hooks—can be selected in its (their) top (possibly bottom) position.

For the weaving of certain weaves in face-to-face pile weaves it must be possible for the pile warp threads to be lifted in three possible positions. In the case of certain weaves these three possibilities for the positions do not have to be present simultaneously on each shot, but it can be sufficient to achieve two positions on the first pick and two other positions on the second pick, so that after these 2 weft insertions the three necessary positions of the warp thread have been achieved. The required selection possibilities in the case of such weaves are illustrated with reference to the appended FIG. 1, which shows schematically a double-shuttle woven face-to-face 2-shot V weave. The three possible positions of the pile warp threads are indicated below by top (T), bottom (B) and middle (M).

The weft threads in the bottom weave are indicated by the letters WB, and the weft threads in the top weave are indicated by the letters WT. In a double-shuttle woven fabric, 2 wefts are simultaneously inserted threads per pick—one in the top fabric (TW), and one in the bottom fabric (BW). The first to the 6th pick has been indicated vertically below that on the figure by means of a serial number (1 to 6).

The two backing fabrics comprise binder warp threads (7) and (7') and (8) and (8') respectively and tight warp threads (9) and (10) respectively.

In addition, the pile warp threads forming the pile are woven between the two backing fabrics which are held at a certain distance from each other, while the dead pile warp threads are bound into either the top fabric or the bottom fabric. Depending on the pattern (the color) which one wishes to obtain in the fabric, a pile warp thread until then forming the pile is bound into the top fabric or bottom weave at a particular weft insertion, and a pile warp thread which has been dead until then can begin to form pile at a particular weft insertion.

The five pile warp threads are indicated in FIG. 1 by P1, P2, P3, P4 and P5. The pile warp threads P1, P2, P3 are provided for binding into the bottom weave. The pile warp threads P4, P5 are provided for binding into the top weave. The three necessary positions of the pile warp threads can be indicated as follows in the figure:

"Bottom" position: the pile warp threads are situated below weft WB of the bottom fabric "Top" position: the pile warp threads are situated above weft WT of the top fabric "Middle" position: the pile warp threads are situated between WB and WT.

The pile warp threads P1, P2, P3 must be able to be lifted in the following positions:

Each odd pick/s "bottom" or "middle"

Each even pick/s "bottom" or "top".

In pick/s 1 to 6 the pile warp thread P1 is lifted in succession, to the following positions: bottom - top - bottom - top - middle - bottom.

The pile warp threads P4, P5, are lifted in the following positions:

Each odd pick/s "bottom" or "top"

Each even pick/s "top" or "middle".

Thus, for example, for pick/s 1 to 6 pile warp thread P5 is lifted in succession to the following positions: top - middle - top - middle - bottom - top.

For each pick/s there consequently has to be the choice between two possible positions of the pile warp threads, while through mutual combination over two pick/s a total of three possible positions have to be provided for every two pick/s. By selection of the hooks, in cooperation with the device to which this invention relates, it must be possible to have either the choice between the positions "bottom" and "middle" or the positions "bottom" and "top", or the positions "top" and "middle" for each pick/s. In the case of the example described above it is even necessary for the required selection possibilities of a particular group of pile warp threads (P1, P2, P3) not to correspond to those of another group of pile warp threads (P4, P5), so that the device in question here will have to be present in two possible embodiments on one Jacquard machine.

A possible embodiment of a known device for achieving the selection possibilities described above makes use of a pulley arrangement comprising three pulley elements, and is illustrated with reference to FIG. 2, which is appended hereto. Each pulley element (1), (2), (3) comprises two rotatable rollers (1'), (1''); (2'), (2'') and (3'), (3'') which are fixed to each other one above the other and in the same plane by a mechanical connection of their shafts. Each warp thread is now connected by means of the harness cord to the bottom end (4') of a pulley cord (4). Tackle cord (4) runs over the bottom roller (3'') of the bottom pulley element (3) and is directed back downwards with the other end connected to a fixed or movable (controllable) point or grid (5). The top pulley roller (3') of pulley element (3) hangs in the loop which is formed by another pulley cord (6) which is hanging down, and of which both ends each lie higher up over one of two bottom pulley rollers (1'') and (2'')—or of pulley elements (1) and (2) hanging at the same height—and are fixed, directed back downwards, each in a fixed point. The top pulley rollers (1') and (2') of the above-mentioned pulley elements (1) and (2) each hang in the loop formed by downward-hanging pulley cords (7) and (8), while each end of each tackle cord (7) and (8) is fixed higher up to one hook of a set of two complementary hooks (9) and (10), and (9') and (10') respectively.

Assuming that the Jacquard machine is equipped to select the hooks (9), (9'), (10), (10') in their top position, we can describe how this known device works as follows:

If no hook at all is selected, then the hooks move up and down in opposite phase to each other, and the pulley elements (1) and (2) then remain hanging at the same height, since each pulley element is suspended in the downward-hanging loop of a cord (7), (8) of which one end moves up and the other end moves down in opposite phase to each other. There is no upward or downward movement of pulley elements at all (only the pulley cords (7) and (8) move to and fro over the rollers (1') and (2')), and the end (4') of tackle cord (4) remains in the "bottom" position.

If one of the hooks, for example hook (9), has been selected in its top position, then in the next phase of the hook movement hook (10) is moved upwards over a distance (h) (=lifting of the knives), and pulley element (1) is raised over half that distance: h/2. Pulley element (2) is in the preceding situation, since neither hook (9') nor hook (10') have been selected, and pulley element (2) remains hanging at the same height. Through the lifting of pulley element (1) over a height (h/2), each pulley element (3) is raised over that distance, which results in a raising of the end (4') of tackle element (4) over a distance (h). The warp threads connected to it are taken into the "middle" position.

If now, for example, the hooks (9) and (9') have been selected, then the hooks (10) and (10') in the subsequent movement phase are moved up over a distance (h), as a result of which both pulley element (1) and pulley element (2) move upwards over a height (h/2). Pulley element (3) thereby undergoes a lifting over a distance (h), as a result of which the bottom end (4') of pulley element (4) is pulled upwards over a distance (2h). The warp threads connected to it are taken into the "top" position. Consequently, for each pick the warp threads can be lifted to one of the three possible positions by selecting none, one, or two of the hooks (9), (10) or (9'), (10').

The disadvantage of this known device lies in the fact that for obtaining these selection possibilities two sets of complementary hooks (9), (10) and (9'), (10') are needed, in conjunction with the pulley arrangement of FIG. 2.

SUMMARY OF THE INVENTION

The object of the invention is to provide a pulley arrangement which in combination with one set of complementary hooks can create three possible positions for the warp threads connected thereto, while the number of complementary hooks does not need to double, and it thus becomes cheaper, and all required selection possibilities for the position of the warp threads are retained.

The object of the invention is a pulley arrangement for a Jacquard machine, connected from the top side to one set of complementary hooks, and from the bottom side to one or more warp threads, by means of which through selection of the hooks there is a possibility of placing these warp threads per repeat of two pick/s in three possible positions in order to form the shed for the pile warp threads on each pick.

The pulley arrangement according to the invention consists in that one set of complementary hooks is connected by means of a downward-hanging pulley cord, while a top pulley element is suspended with its top roller in the so formed loop. Fixed to one of the hooks is the end of a second pulley cord which hangs down lower than the top pulley element and is passed with the other end around the top roller of said second pulley and then runs back up over the bottom roller of the top pulley element and is connected again lower down than said roller to a fixed or controllable grid.

Lying over the bottom roller of this bottom pulley element a third tackle cord is suspended which is connected with one end lower to one or more warp threads (by means of harness cords), and is connected to a fixed or controllable grid with the other end lower than the bottom pulley roller of the bottom tackle element.

Another possible embodiment of the pulley suspension according to the invention is characterised in that the top pulley element is suspended directly from one of the hooks on the top roller, while another pulley cord is connected by one end to the other hook, lower down than the bottom pulley roller of the top pulley element (2) is hanging down, and further runs back up over the bottom pulley roller of the top pulley element, in order in the end to be connected by the second end to the top fixed or controllable grid, while this grid lies lower down than the above-mentioned bottom pulley roller.

The bottom pulley element then hangs with its top pulley roller in the downward-hanging loop which is formed by this pulley cord. A tackle cord running over the bottom pulley roller of this bottom pulley element is then further connected than in the case of the first embodiment to the warp threads, on the one hand, and to a fixed or controllable grid, on the other.

Further features, advantages and possibilities of the pulley arrangement according to the invention are illustrated by means of the detailed description which follows of two possible embodiments of the pulley arrangement according to the invention, the invention not thereby being restricted to these two possible embodiments.

BRIEF DESCRIPTION OF THE DRAWINGS

This description is illustrated with reference to the figures appended hereto, in which.

DETAILED DESCRIPTION OF THE DRAWINGS

Figure 3:
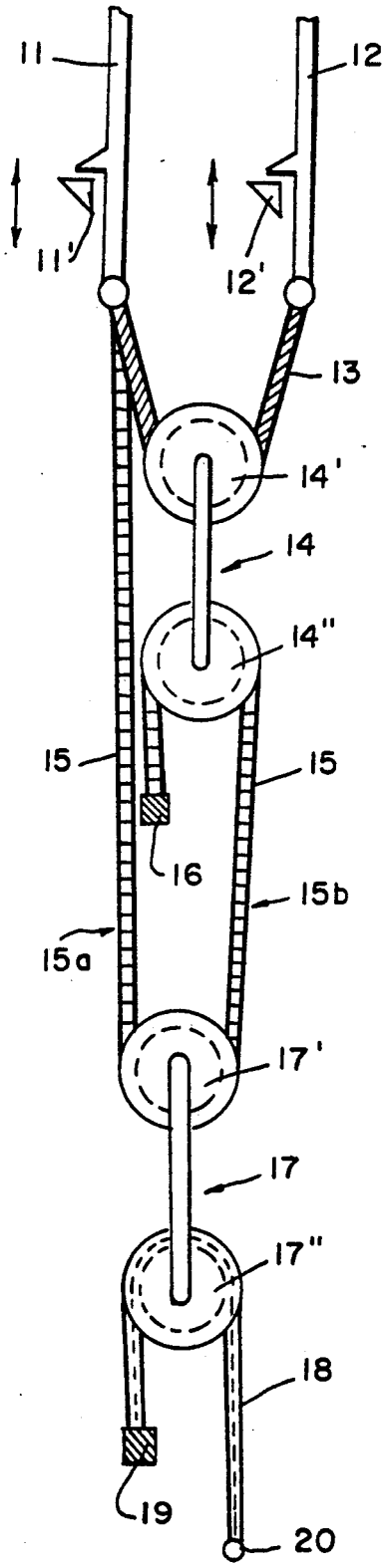
FIG. 3 shows schematically a side view—in conjunction with one set of complementary hooks—of the first possible embodiment of the pulley arrangement according to the invention.

The tackle suspension according to the invention consists in that (see FIG. 3) in a first possible embodiment the two ends of a pulley cord (13) are fixed at the bottom side of each of the hooks (11) and (12) forming a set of complementary hooks, said pulley cord (13) hanging down in a loop. A tackle element (14) with its top roller (14') is hung in said loop. One end of a second tackle cord (15) is fixed to the bottom side of one of the hooks (11).

This pulley cord (15) hangs down in a loop, and the other end is laid over the bottom roller (14'') of the pulley element (14), and connected to a fixed or controllable grid (16), said grid being disposed lower down than the pulley roller (14''). A pulley element (17) with the top roller (17') is now suspended in the downward-hanging loop formed by pulley cord (15). Over the bottom roller (17'') of the pulley element (17) lies a pulley cord (18), one end (20) of which is connected to one or more harness cords, which are in turn connected to warp threads, and the other end of which is connected to a fixed or controllable grid (19). This grid (19) is disposed lower down than the pulley roller (17''). The grids (16) and (19) can both be disposed in a fixed manner, and one of the two or both grids (16) or (19) can be controllable, while the movements of said grids in that case also take place vertically and take place together with one of the two complementary knives (11') or (12') over the same distance (h).

Figure 4:
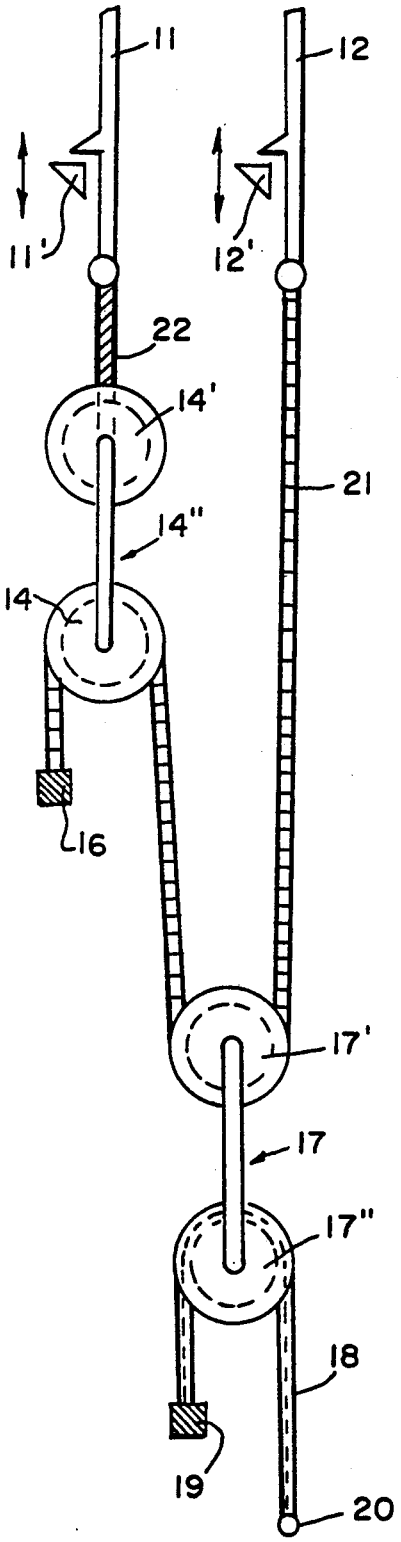
FIG. 4 shows schematically a side view—in conjunction with one set of complementary hooks—of the second possible embodiment of the pulley arrangement according to the invention.

FIG. 4 shows schematically a second possible embodiment of the pulley arrangement according to the invention.

Here the top pulley element (14) is suspended directly by a fixed cord from the top roller (14') at the bottom side of one of the hooks (11). Fixed at the bottom side of the other (complementary) hook (12) is the end of a pulley cord (21) which is made to hang lower down than the bottom tackle roller (14'') in a loop, and is taken back up and laid over the bottom pulley roller (14''), and the other end is then fixed to the grid (16) disposed horizontally lower down, while this grid can be disposed in a fixed manner or movable with one of the knives (11') and (12').

The bottom pulley element (17) with its top pulley roller (17') is now suspended in the loop formed with the pulley cord (21). The pulley cord (18) then hangs over the bottom pulley roller (17''), which pulley cord is connected with one end (20) lower to one or more warp threads, and with the other end is connected to the grid (19) situated lower down, said grid (19) being disposed so that it is fixed or controllable with one of the knives (11') or (12').

Figures 5A, 5B, 5C, 5D, 5E, 5F, 5G, 5H:
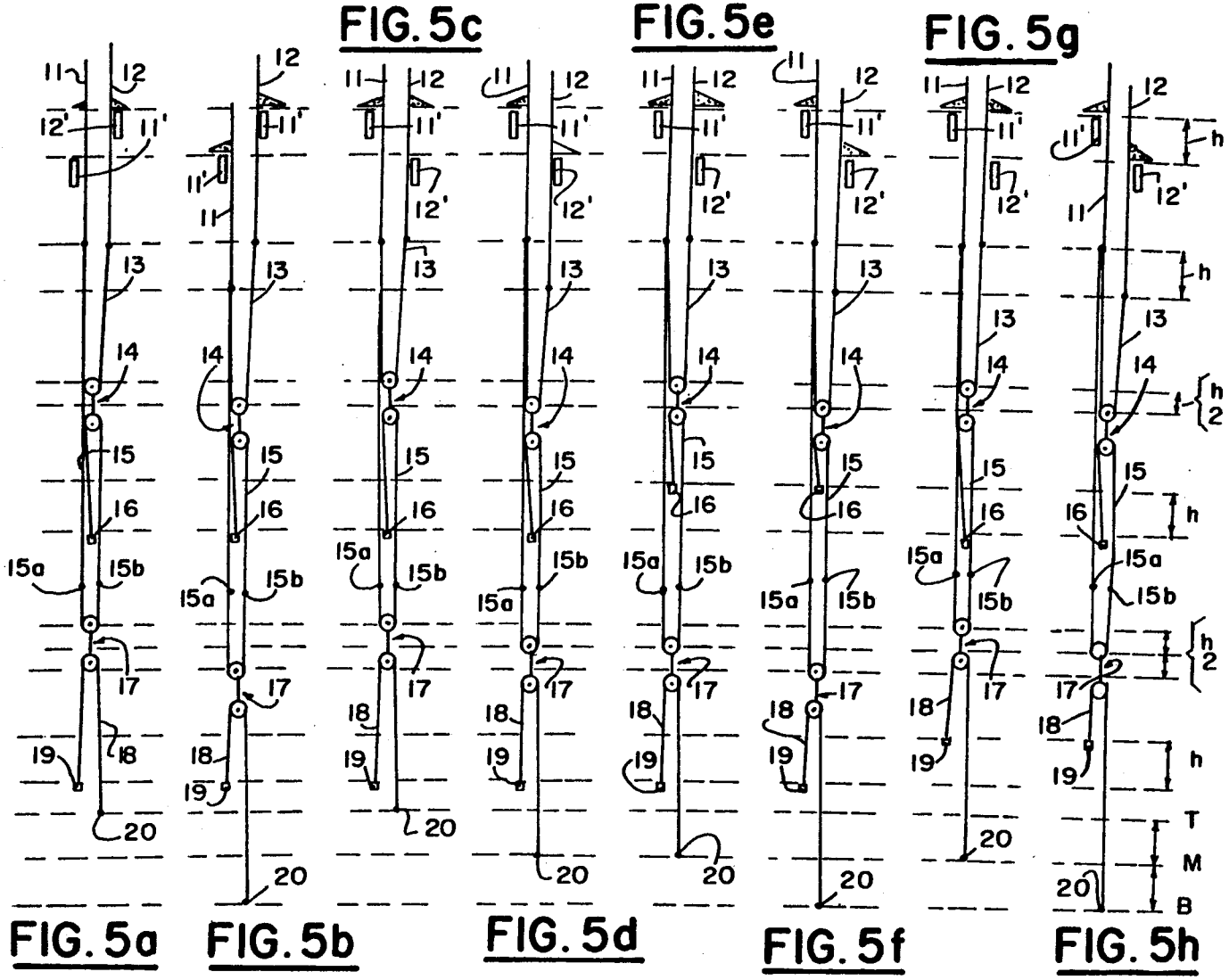
FIGS. 5*a* to 5*p* show a number of possible positions of the hooks and the controllable grids in the pulley arrangement according to the invention, in order to obtain the three possible positions of the warp thread connected thereto.
Figures 5I, 5J, 5K, 5L, 5M, 5N, 5O, 5P:
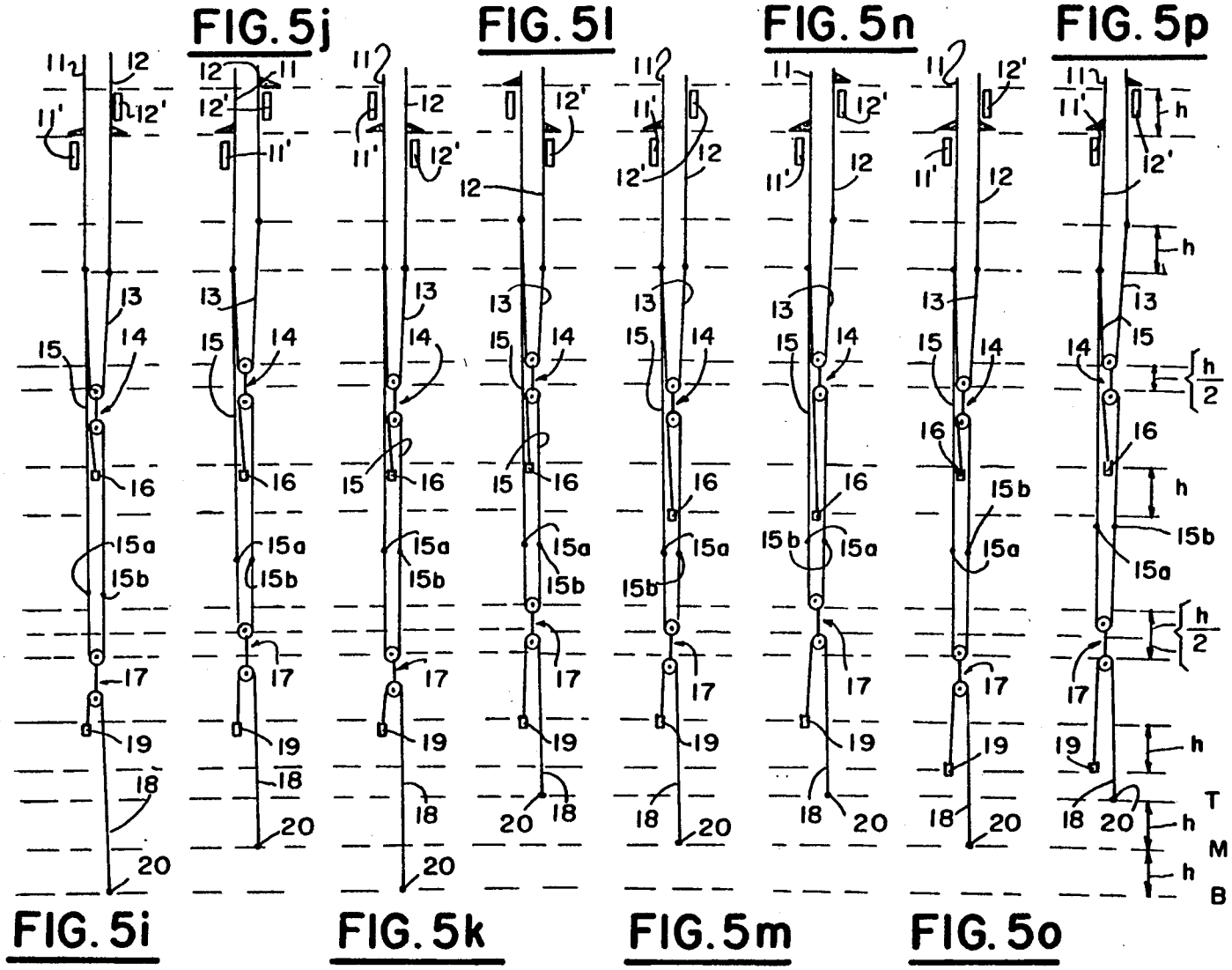

FIGS. 5*a* to 5*p* show the different possibilities by which the three possible positions of the warp threads can be obtained.

In FIG. 5*a* the hook (11) is selected in its top position, and the grids (16) and (19) are assumed to be fixed. When the hook (12) is taken up by knife (12') the pulley element (14) is raised over a height h/2. The top end of tackle cord (15) is raised over a height h, and consequently also the point 15*a*.

Since pulley element (14) goes up a height h/2, point 15*b* of the pulley cord (15) also moves upwards a distance h.

Since both point 15*a* and point 15*b* are raised over a height (h), pulley element (17) also moves up over a distance (h). The end (20) of pulley cord (18) is consequently raised over a distance 2h. The warp threads thereby move from their original "bottom" position to the "top" position.

In FIG. 5*b* we look at the case in which none of the hooks has been selected, and in which hook (12) is in its top position and hook (11) is in its bottom position. Pulley element (14) remains hanging in its bottom position, since the movements of the two hooks (11) and (12) compensate for each other.

The point (15*b*) on pulley cord (15) is thus also situated in its lowest position. The top end of pulley cord (15) is situated together with hook (11) in its lowest position, as a result of which point (15*a*) is also situated in its lowest position. Consequently, pulley element (17)—and also the end (20) of pulley cord (18)—hangs in the lowest position. The warp threads connected thereto are in the "bottom" position.

In FIG. 5*c* hook (12) has been selected, while knife (12') is down and knife (11') up. The situation for the pulley arrangement is identical to that of FIG. 5*a*.

FIG. 5*d* shows the situation in which no hook at all has been selected and in which hook (12) is in its lowest position and hook (11) in its top position. Pulley element (14) is in its lowest position, and the point (15*b*) is consequently in its lowest position. Through the lifting of hook (11) the point (15*a*) moves over a distance h upwards, and the pulley element (17) moves so that it is hanging a distance h/2 further up. This results in a lift over a distance h of the end (20) of pulley cord (18). The warp threads have now been moved into the "middle" position.

We can now look at the already considered situations for the hooks in the case where the top grid (16) together with the knife (11') is raised over a height h, while the bottom grid (19) remains fixed.

For the cases shown in FIGS. 5*a* and 5*b* nothing changes, since the knife (11') is in its bottom position there.

For the cases proposed in FIGS. 5*c* and 5*d* the only difference obtained through the lifting of grid (16) is that point (15*b*) moves down over a distance h, as a result of which pulley element (17) comes to hang over a distance h/2 lower. The effect of the raising of grid (16) over a height h is thus that the end (20) comes to lie a distance h lower compared with the same hook selections without raising of the grid (16).

In FIGS. 5*e* and 5*f* we thus obtain the position "middle" and the position "bottom" respectively as the position for the warp threads.

In FIGS. 5*g* and 5*h* we look at the effect of the raising of the bottom grid (19) over a height h, together with the knife (11'). It is evident that end (20) thereby comes to lie a distance h lower than in the case of identical hook selections without raising of grid (19). Consequently, the result obtained is the position "middle" and "bottom" respectively for the warp threads.

If the hooks are not selected, in the case of two successive weft insertions we first reach the situation of FIG. 5*b* and then the situation of FIG. 5*d*. For the warp threads we obtain in succession the position "bottom" (raising of hook (12)) and the position "middle" (raising of hook (11)).

As regards the warp threads, we can say in general that (on selection of the hooks in the top position) without hook selection the raising of hook (11) achieves a "middle" position, and the raising of hook (12) a "bottom" position, while the raising of each of the grids (16) and (19) produces a lowering over a distance h. In the case of hook selection of one of the hooks in its top position we arrive at the "top" position.

In the case of hook selection in the bottom position of the hooks there are also three possible positions (bottom, middle and top) for the warp threads. In FIGS. 5I to 5L the grids (16) and (19) are in each case both considered fixed. This fixed position is h higher than in the case of top selection; FIGS. 5*a* to 5*d*.

If no selection of the hooks has taken place, then the highest position is obtained if the hook (11) is taken up (FIG. 5I). This becomes the "top" position for the warp threads. If the hook (12), on the other hand, is at the top, the "middle" position is obtained.

The raising of the hook (11) alone results in a lifting over a distance 2h being obtained for the end (20) of pulley cord (18). The raising of the hook (12) alone results in a raising over a distance (h). The lowest position for the warp threads (the "bottom" position is obtained if one of the hooks is selected in the bottom position. If the other hook is then lowered, the two are at the bottom. Pulley element (14) is in its bottom position, and both point (15*a*) and point (15*b*) are in their lowest position. Pulley element (17) consequently goes into its lowest position, which in the end results in the lowest possible position for pulley cord end (20).

The effect of lifting of one grid (16) or (19) over a distance h is here, of course, also that the pulley cord end (20) falls over a distance h. Conversely, the drop of a grid (16) or (19) over a distance h results in the rise of pulley cord end over a distance h (FIG. 5M to 5I). Here again the grids—one of them or both—can be provided so that they move along with one of the knives (11') or (12').

For illustration of the possibilities for use of the device according to the invention we look at a weave of a pile fabric woven with wires (see schematic illustration in FIG. 6): 2 picks with pattern through to the back.

On each pick one weft W has been inserted. On every second pick (2nd, 4th . . . ) a pile loop II is formed about. The pile warp threads can act as figure-forming pile warp thread by being above the pile P on every second shot. This position is called top (T).

The bottom position (B) is reached by a pile warp thread which is below the weft W. The middle position (M) is above the weft W, but below the wire.

The pile warp threads P1, P2, P3 can be lifted to the following positions on each pick:

On every 1st pick: P1 "bottom"; P2 and P3: "middle"

On every 2nd pick: P1 "top"; P2 and P3: "bottom".

The Jacquard machine which can meet these requirements comprises a knife grid with knives (11') and a knife grid with knives (12') moving up and down in opposite phase to each other. The selection of the hooks (11) and (12) can take place in the top and bottom position. If such selection takes place in the top position, grid (16) is made to move along with the knife grid (11'), while the grid (19) remains fixed.

Figure 7A:
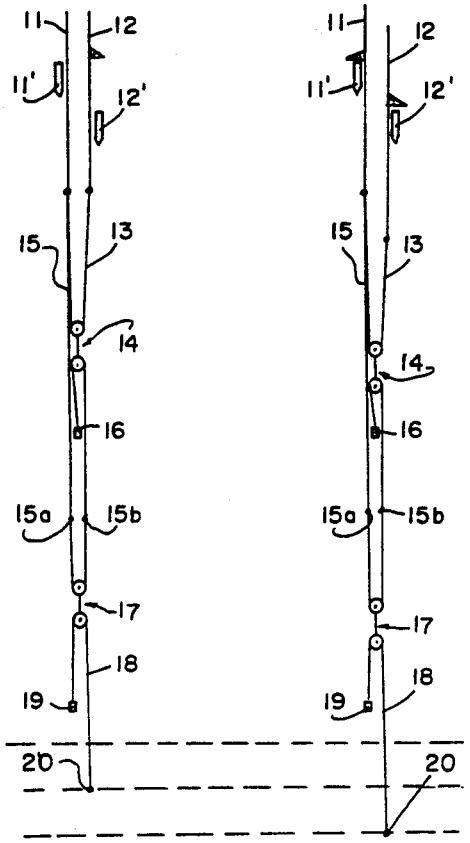
FIGS. 7*a* and 7*b* show how the Jacquard machine works—if the hook selection takes place at the top—for achieving the weave of FIG. 6, with an indication of the various selection possibilities on the 1st pick and the 2nd pick.

On each first pick the warp threads have to be moved either into the "middle" position or into the "bottom" position. The position of the device according to the invention is shown in FIG. 7*a* for those two possibilities on the first pick. In the case of the first pick the knife (11') is up and the knife (12') down.

On selection of hook (12) the hooks (11) and (12) are at that moment in the "top" position, raised over a height h. Pulley element (14) is moved a distance h/2 higher, as a result of which the point (15*b*) of pulley cord (15) moves a height h higher. Since grid (16) also moves up over a distance h, the raising of the point (15*b*) is counteracted. Through the raising of hook (11) point (15*a*) is raised a height h. Tackle element (17) is pulled upwards over a height h/2. Since grid (19) is fixed, in the end we obtain a rise h of the end (20) of pulley cord (18). The warp threads go into the "middle" position.

If hook (12) has not been selected, then hook (11) is in the "top" position, while hook (12) is in the "bottom" position.

The point (15*a*) is given a lift over a height (h). Pulley element (14) is in its lowest position, as a result of which the point (15*b*) of pulley cord (15) is not lifted. Since the grid (16) moves up a height h—together with knife (11')—the resulting movement of the point (15*b*) is a fall over a height (h).

Point (15*a*) rises over a distance h, while (15*b*) falls over a distance h, so that pulley element (17) undergoes no lifting and is situated in its lowest possible position. Grid (19) is fixed, so that end (20) of pulley cord (18) also hangs in its lowest position. The warp threads are consequently situated in the "bottom" position.

Through selecting or not selecting the hook (12) before the first pick, we have the choice between the "middle" or "bottom" positions for the warp threads.

In the case of the second pick the knife (12') is situated in the highest position, while knife (11') takes up the lowest position. On selection of the hook (11) both hooks (11) and (12) are in the position with lift h, as a result of which they pull pulley element (14) up over a height h/2 higher than its lowest position. Point (15*a*) has a lift h, while point (15*b*) is also raised a height h.

Pulley element (17) is raised over a height h, as a result of which the end of pulley cord (18)—in conjunction with fixed grid (19)—receives a lift over a height 2h. The warp threads will go into the "top" position.

The grid (16) remains disposed in its bottom position, since the knife (11') to which it is connected is at the bottom.

If hook (11) is not selected, then hook (11) is in its lowest position, and hook (12) is taken into its top position.

Pulley element (14) is in its lowest position, with the result that the point (15*b*) is not raised and is in its lowest position. The point (15*a*) is also in its lowest position—hook (11) is down—with the result that tackle element (17) is also in its lowest possible position. Pulley cord (18), which is connected to fixed grid (19), consequently has its end (20) in the lowest possible position.

The warp threads will be moved into the "bottom" position.

By selecting or not selecting hook (11), on the second pick one consequently has the choice of moving the warp threads into the "top" or "bottom" position.

Figure 7B:
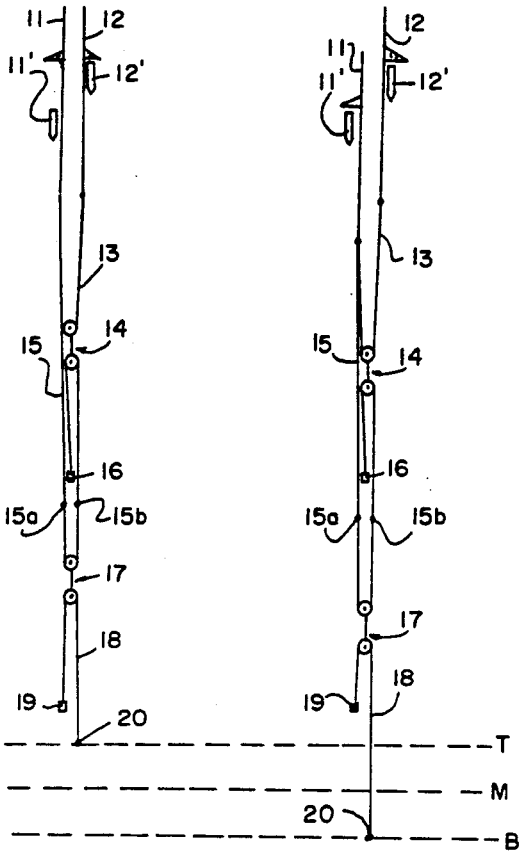
Figure 6:
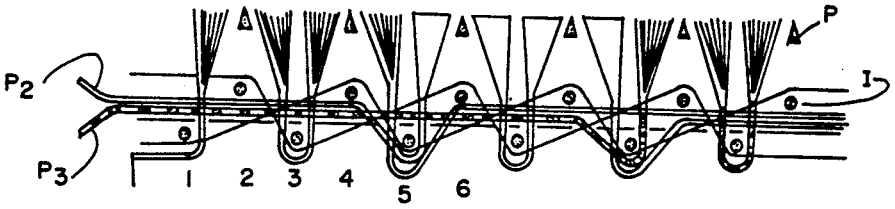
FIG. 6 shows schematically a weave of a pile fabric woven with wires.

The selection possibilities shown in FIGS. 7*a* and 7*b* for the first and second pick respectively consequently correspond completely to the necessary positions of the warp threads for weaving the weave of FIG. 6, for the pile warp threads P1 ("bottom" and "top" positions) and for the pile warp threads P2 and P3 ("middle" and "bottom" positions).

Figure 8B:
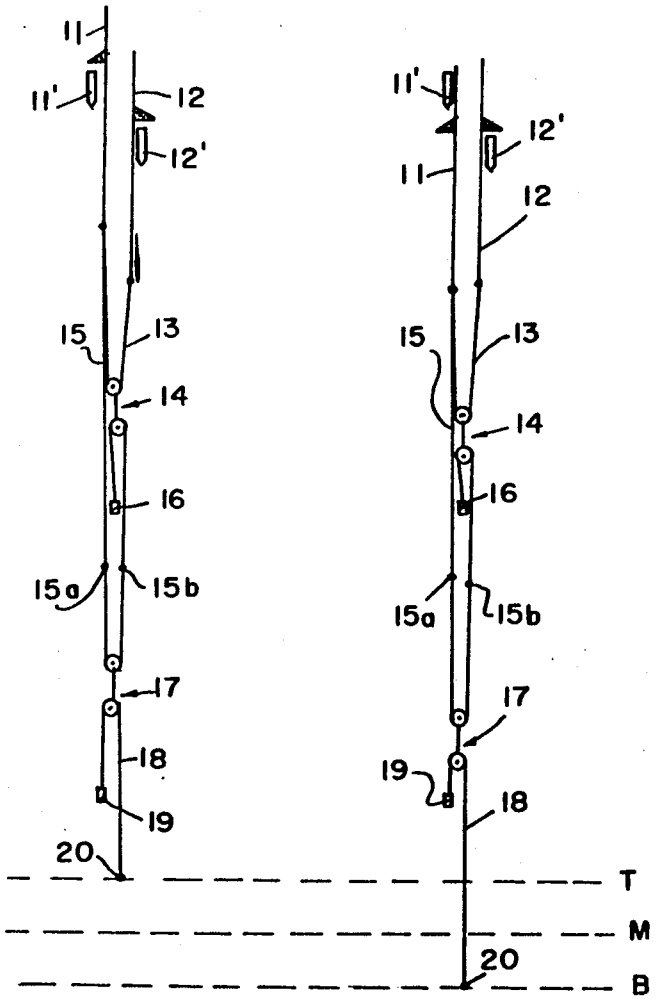
FIGS. 8*a* and 8*b* show how the Jacquard machine works—when the hook selection takes place at the bottom—for achieving the weave of FIG. 6, with an indication of the various selection possibilities on the 1st pick and the 2nd pick.
Figure 8A:
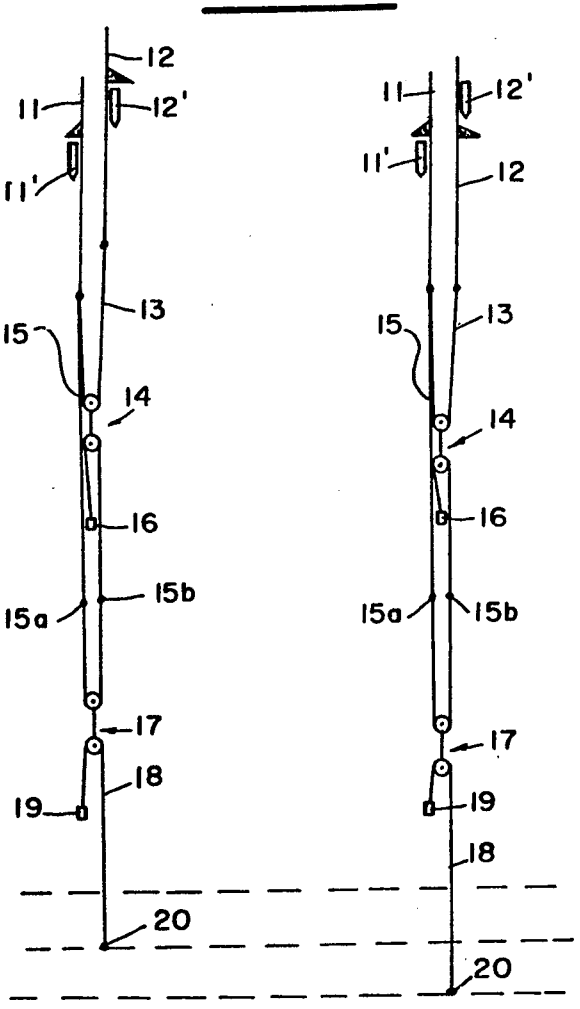

In the event of the selection of the hooks (11) and (12) taking place in the bottom position, the two grids (16) and (19) are fixed. The necessary positions of the device according to the invention are shown in FIGS. 8*a* and 8*b* for the first and the second pick respectively when weaving the weave of FIG. 6. The first pick takes place when the knife (12') is in its top position, and the knife (11') in its bottom position. If the hook (11) has not been selected, then pulley element (14) undergoes a lift h/2 above its lowest possible position—this is if both hooks (11) and (12) are at the bottom. The point (15*a*) undergoes no lift, while the point (15*b*) undergoes a lift over a height h.

Pulley element (17) consequently comes to hang over a height h/2 higher, as a result of which the end (20) of the pulley cord (18) is finally raised over a height h above its lowest possible position. The warp threads go into the "middle" position.

The other necessary position for the warp threads, on the first pick, is obtained by selection of the hook (12) in its lowest position. Both hooks are consequently in their lowest position for the first pick, as a result of which pulley element (14) and consequently also point (15*b*) go into their lowest position. Point (15*a*) is also in the lowest position, as a result of which the pulley element (17) also hangs in its lowest position. The end (20) of a pulley cord (18) consequently hangs in the lowest position. The warp threads go into the lowest position, the "bottom" position.

In the case of the first pick the necessary positions "middle" and "bottom" are thus obtained for the warp thread by selecting the hook (11) or not selecting it in its bottom position.

In the case of the second pick the necessary positions "top" and "bottom" are obtained by selecting the hook (11) or not selecting it in its bottom position. If the hook (11) is not selected, the hook (11) is at the top, and the hook (12) is in its lowest position for the second pick. Pulley element (14) is raised a height h/2 above it lowest position, which leads to a lift over a height h for the point (15*b*). Point (15*a*) is also raised over a height h, so that the pulley element (17) comes to hang a height h higher. End (20) of tackle cord (18) is thereby raised over a distance 2h. The warp threads are consequently taken into the "top" position.

If the hook (11) is selected, for the second pick the situation in which both hooks (11) and (12) are in their bottom position is obtained. This situation for the device according to the invention is the same as that obtained in the case of selection of hook (12) in its lowest position, which has been described in detail above. The "bottom" position for the warp threads is consequently also obtained.

Figure 1:
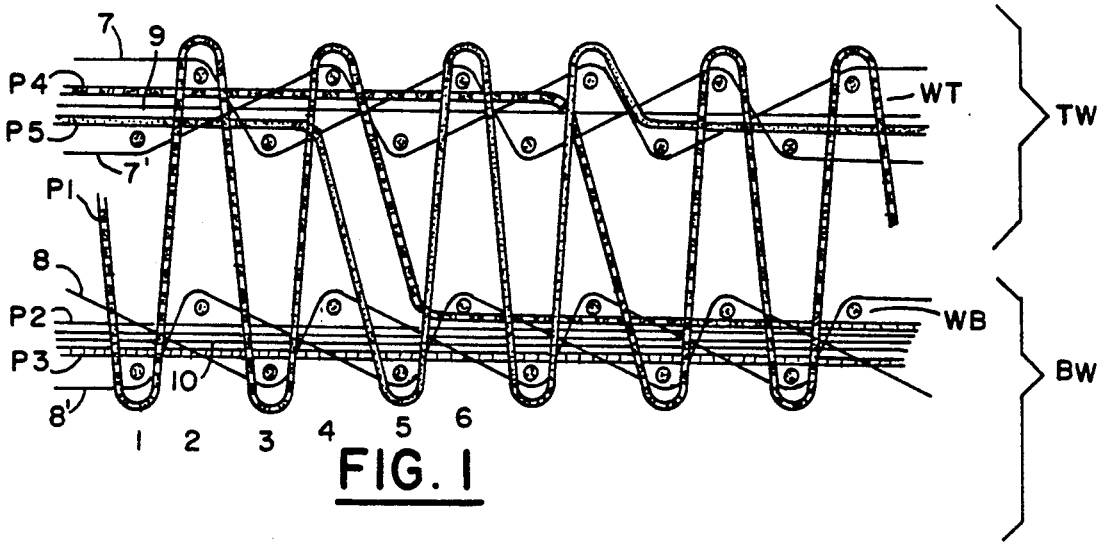
FIG. 1 is a schematic representation of a double shuttle woven 2-shot V-weave.
Figure 2:
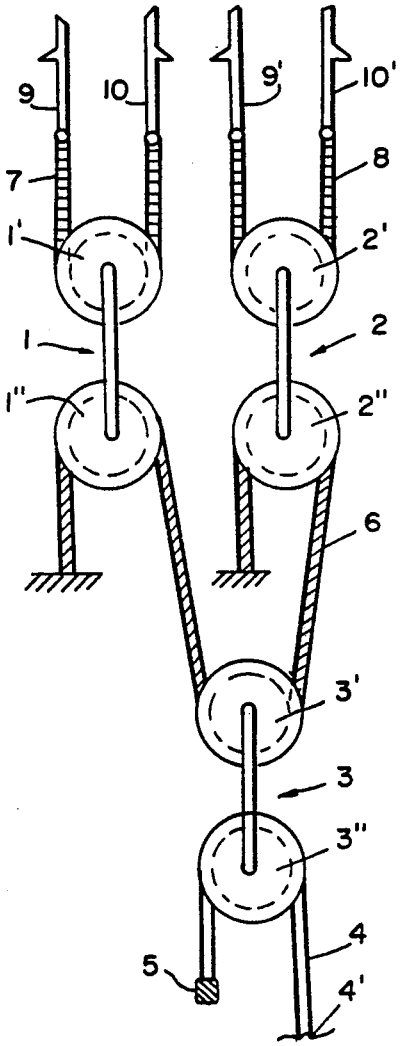
FIG. 2 is a schematic representation of a prior art pulley arrangement.

For another possible application of the device according to the invention we can refer back to FIG. 1, which shows schematically a double-shuttle woven face-to-face pile fabric in the 2-shot V weave.

For each first pick in this case for a part of the pile warp threads (P1, P2, P3) the selection possibility must be between the "bottom" or "middle" positions, while for another part of the pile warp threads (P1, P5) the selection possibility must be between the "bottom" and "top" positions.

For each second pick for this weave the selection possibility for the first group of pile warp threads must be between the positions "bottom" and "top", while for the second group of pile warp threads (P4, P5) the selection possibility must be between the positions "top" and "middle".

Figure 9B:
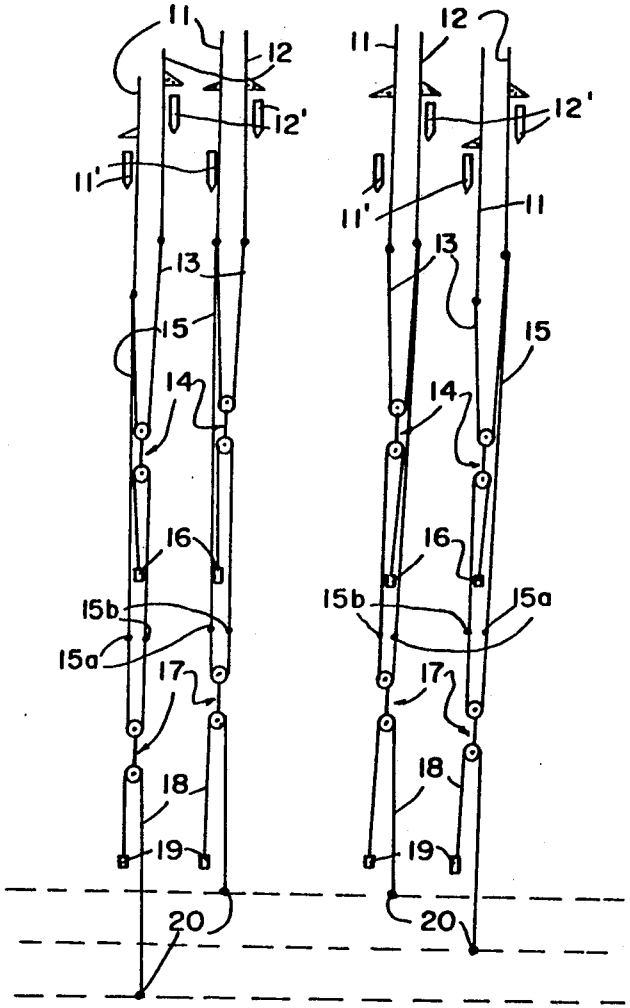
FIGS. 9*a* and 9*b* show how the Jacquard machine works—when the hook selection takes place at the top—for achieving the weave of FIG. 1, with an indication of the various selection possibilities on the 1st pick and the 2nd pick, for the two groups of pile warp threads.
Figure 9A:
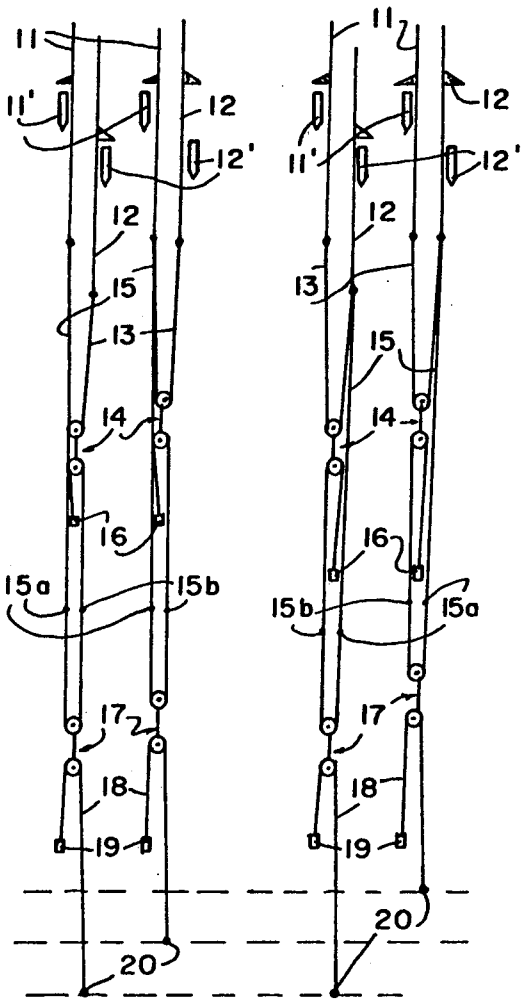

For the first pick the necessary selection possibilities for the device according to the invention are shown in FIG. 9*a*; for the second pick we would refer you to FIG. 9*b*.

For the first group of pile warp threads the grid (16) is set up so that it is movable—together with knife (11')—and the grid (19) is fixed, while for the second group of pile warp threads the two grids are fixed.

The arrangement for the 1st group of pile warp threads is in each figure to the left of the arrangement for the 2nd group of pile warp threads.

For the first pick there are two selection possibilities (namely "bottom" and "middle") for the first group of pile warp threads by selecting or not selecting the hook (12) in its top position. For this we can refer to the description relating to FIG. 7*a*.

In the case of the second group of pile warp threads the pulley cord (13) is fixed to hook (11) and pulley cord (15) to hook (12), exactly the opposite to what has always been the case hitherto. Both grids (16) and (19) are fixed. This situation is identical to that of FIG. 7*b*, but through the changeover we now obtain these positions ("bottom" and "top") for the first pick.

For the second group of pile warp threads we obtain the necessary selection possibilities by selecting or not selecting the hook (12) in the top position, while the grids (16) and (19) must be fixed.

The Jacquard machine must consequently be in two sections: a section for the first group of pile warp threads with movable grid (16), and a section for the second group of pile warp threads with fixed grids (16) and (19), and with a changed-over pulley arrangement.

For the second pick, we need the choice between the "bottom" and "top" positions for the first group of pile warp threads. The positions for the device according to the invention which comply with this correspond to FIG. 7*b*.

By selecting or not selecting the hook (11) in its top position the "top" and "bottom" position respectively is achieved.

For the second group of pile warp threads we need the choice between the "top" and "middle" positions for the second shot.

The "top" position is obtained in the same way as for the first group of pile warp threads in the case of the second pick: namely, by selecting the hook (11) in its top position. The position of the device is identical, given the fact that the changeover of the pulley arrangement does not play a part if both hooks (11) and (12) are at the top, and if knife (11') is down (movable grid (16) is equal to fixed grid (16)).

The "middle" position is obtained by not selecting the hook (11) for the second pick. Pulley element (14) is in its lowest possible position and consequently also the point (15*b*). The point (15*a*) is raised by hook (12) over a height h. Pulley element (17) comes to hang over a distance h/2 higher, as a result of which the end (20) of pulley cord (18) comes to hang a height h above its lowest position. The warp threads are consequently taken into their "middle" position.

Figure 10:
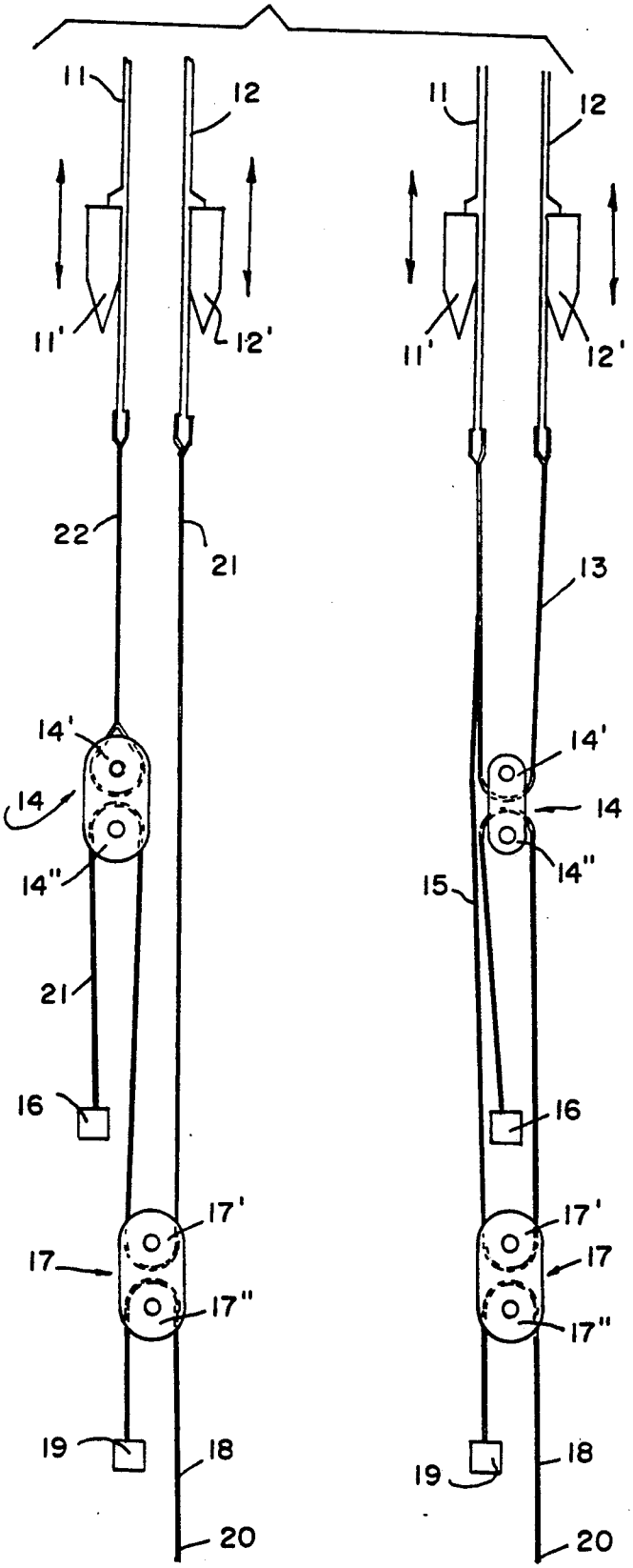
FIG. 10 shows a side view of the two embodiments of the pulley arrangement according to the invention, for one set of complementary hooks.
Figure 11:
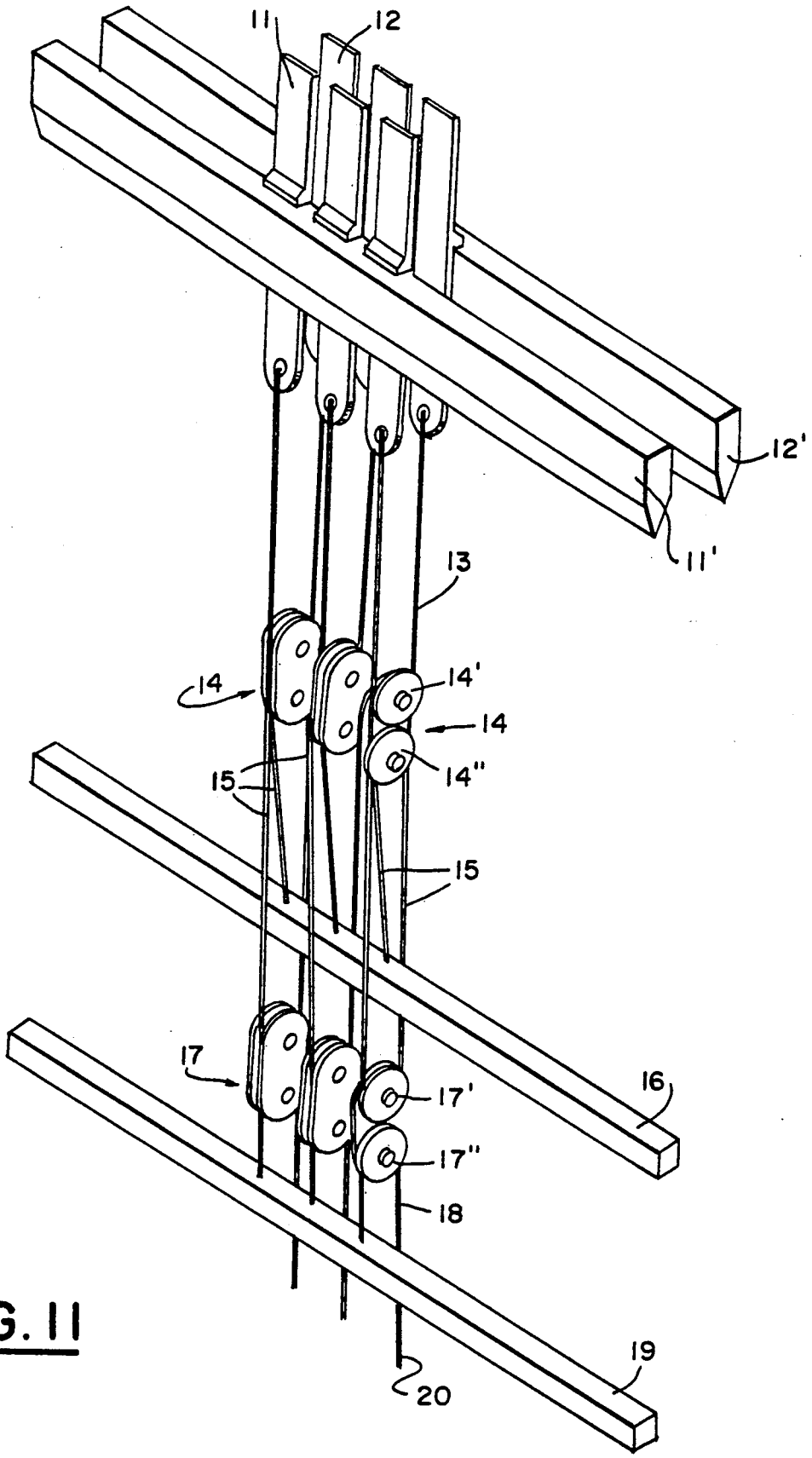
FIG. 11 shows a perspective drawing of the layout and a part of the pulley arrangement according to the first embodiment of the invention, for 3 sets of complementary hooks.

In order to illustrate the practical realization of the pulley arrangement according to the invention, in a preferred embodiment we refer to FIG. 10, which shows a side view of the section of the device which works with one set of complementary hooks. The pulley arrangement shown in FIG. 10 is connected to each set of complementary hooks of the Jacquard machine. FIG. 11 shows a perspective view of the section of the device which works together with three sets of complementary hooks.

Each hook (11) and (12) comprises an elongated strip, provided with a projection along one side edge. Below each row of hooks, precisely below the projection of said hooks, is a knife (11'), (12'), both carrying out an up and down movement in opposite phase to each other, while during their movements they can carry the hooks (11) and (12) up with them. For this, the shape and size of the projection of each hook (11) and (12) are such that said hook (11) and (12) can rest on the top side of the knife (11) or (12) lying below during the upward movement thereof.

On the bottom side of each hook (11) and (12) there is an opening which serves to fix pulley cords (13) and (15).

The ends of two pulley cords are fixed at the bottom side of all hooks (11) belonging to the same row. The end of pulley cord (13) and the end of pulley cord (15). Pulley cord (13) hangs down and runs over the bottom side of the top pulley roller (14') of tackle element (14), and then back up, where the second end of said pulley cord (13) is connected to the bottom side of the hook (12)—the complementary hook belonging to another row.

The pulley cord (15) hangs down lower than tackle cord (13) and runs over the bottom side of the top pulley roller (17') of pulley element (17), and then back up, where it is guided over the top side of the bottom pulley roller (14'') of pulley element (14), and further runs back down, where the end is connected to a grid (16). Grid (16) can either be fixed or movable, in which case it can follow the movements of knife (11') or (12').

Each pulley element (14) and (17) comprises a top and a bottom pulley roller (14'), (17') and (14''), (17'') respectively which are disposed above one another so that they rotate on parallel shafts. Both shafts are also mechanically connected to each other by known means—through, for example, two side plates parallel to the two lateral flanks of the pulley rollers.

Both pulley elements (14) and (17) consequently hang with their top pulley roller in the loop formed by the downward-hanging pulley cords (13) and (15), while the pulley cords (13) and (15) run over the above-mentioned pulley rollers (14) and (17).

Over the top side of the bottom pulley roller (17'') of pulley element (17) runs another tackle cord (18) which is connected with one end downwards to the grid (19) and with the other end (20) is connected lower down to one or more harness cords connected to the warp threads. Grid (19), like grids (16), can be set up either in a fixed manner or movable, so that it follows the movements of knife (11') or knife (12'). FIG. 11 shows a number of the slats of the grids (16) and (19) connected to the pulley cords (15) and (18).

The advantage of the invention lies in the fact that only one set of complementary hooks (11) and (12) is needed per pile point to make three different positions of the warp threads possible. Hitherto, two sets of complementary hooks per pile point were necessary to provide that possibility, which meant that the Jacquard machine took up more space.

I claim:

1. Jacquard machine provided with a pulley arrangement comprising plural pulley elements and plural complementary hooks connected by means of plural vertically movable pulley cords, such that control of a suspension point of the pulley cord enables a selection of three possible positions for the warp threads for at least each of two picks, characterized in that each pulley arrangement works together with one set of two of the complementary hooks, and comprises a first and a second pulley element being suspended above one another, each pulley element comprising a top and a bottom roller connected above one another and suspended below each set of the complementary hooks by means of a first pulley cord, each end of the first pulley cord being fixed to one of the complementary hooks, while a downward-hanging portion of the first pulley cord runs over the top roller of the first pulley element, thereby suspending the first pulley element, one end of a second pulley cord being attached to one of the complementary hooks, a portion of the second pulley cord hanging below the first pulley element runs over the top roller of the second pulley element and runs back up over the bottom roller of the first pulley element with another end of the second pulley cord being connected to a fixed point of the Jacquard machine, and guided over the bottom roller of the second pulley element is a third pulley cord having one end connected to a fixed point of the Jacquard machine and having another end connected to one or more warp threads by means of plural harness cords.

2. Jacquard machine provided with a pulley arrangement comprising plural pulley elements and plural complementary hooks connected by means of plural vertically movable pulley cords, such that control of a suspension point of the pulley cord enables a selection of three possible positions for the warp threads for at least each of two picks, characterized in that each pulley arrangement works together with one set of two of the complementary hooks, and comprises a first and a second pulley element being suspended above one another, each pulley element comprising a top and a bottom roller connected above one another and suspended below each set of the complementary hooks, one end of a first pulley cord being fixed to one of the complementary hooks and another end being attached to the first pulley element, thereby suspending the first pulley element, one end of a second pulley cord being attached to the other complementary hook, a portion of the second pulley cord hanging below the first pulley element runs over the top roller of the second pulley element and runs back up over the bottom roller of the first pulley element with another end of the second pulley cord being connected to a fixed point of the Jacquard machine, and guided over the bottom roller of the second pulley element is a third pulley cord having one end connected to a fixed point of the Jacquard machine and having another end connected to one or more warp threads by means of plural harness cords.

3. Pulley arrangement for forming a shed in the warp threads in a Jacquard machine, comprising plural pulley elements and plural complementary hooks connected by means of plural vertically movable pulley cords, such that control of a suspension point of the pulley cord enables a selection of three possible positions for the warp threads for at least each of two picks, characterized in that each pulley arrangement works together with one set of two of the complementary hooks, and comprises a first and a second pulley element being suspended above one another, each pulley element comprising a top and a bottom roller connected above one another and suspended below each set of the complementary hooks by means of a first pulley cord, each end of the first pulley cord being fixed to one of the complementary hooks, while a downward-hanging portion of the first pulley cord runs over the top roller of the first pulley element, thereby suspending the first pulley element, one end of a second pulley cord being attached to one of the complementary hooks, a portion of the second pulley cord hanging below the first pulley element runs over the top roller of the second pulley element and runs back up over the bottom roller of the first pulley element with another end of the second pulley cord being connected to a fixed point of the Jacquard machine, and guided over the bottom roller of the second pulley element is a third pulley cord having one end connected to a fixed point of the Jacquard machine and having another end connected to one or more warp threads by means of plural harness cords.

4. Pulley arrangement according to claim 3, characterised in that the second pulley cord (15) is connected by an end not connected to the hook (11) to a grid (16) which is movable up and down in phase with one of plural knives (11'), (12') over a height h equal to that of a lift of said knives.

5. Pulley arrangement according to claim 3, characterized in that the third pulley cord (18) is connected by the end not connected to the warp threads to a grid (19) which is movable up and down in phase with one of plural knives (11'), (12') over a height h equal to that of a lift of said knives.

6. Pulley arrangement for forming a shed in the warp threads in a Jacquard machine, comprising plural pulley elements and plural complementary hooks connected by means of plural vertically movable pulley cords, such that control of a suspension point of the pulley cord enables a selection of three possible positions for the warp threads for at least each of two picks, characterized in that each pulley arrangement works together with one set of two of the complementary hooks, and comprises a first and a second pulley element being suspended above one another, each pulley element comprising a top and a bottom roller connected above one another and suspended below each set of the complementary hooks, one end of a first pulley cord being fixed to one of the complementary hooks and another end being attached to the first pulley element, thereby suspending the first pulley element, one end of a second pulley cord being attached to the other complementary hook, a portion of the second pulley cord hanging below the first pulley element runs over the top roller of the second pulley element and runs back up over the bottom roller of the first pulley element with another end of the second pulley cord being connected to a fixed point of the Jacquard machine, and guided over the bottom roller of the second pulley element is a third pulley cord having one end connected to a fixed point of the Jacquard machine and having another end connected to one or more warp threads by means of plural harness cords.

7. Pulley arrangement according to claim 6, characterized in that the second pulley cord (21) is connected by the end not connected to the hook (12) to a grid (16) which is movable up and down in phase with one of plural knives (11'), (12'), over a height h equal to that of a lift of said knives.

8. Pulley arrangement according to claim 6, characterized in that the third pulley cord (18) is connected by the end not connected to the warp threads to a grid (19) which is movable up and down in phase with one of plural knives (11'), (12'), over a height h equal to that of a lift of said knives.

* * * * *

UNITED STATES PATENT AND TRADEMARK OFFICE

CERTIFICATE OF CORRECTION

PATENT NO. : 5,139,052

DATED : August 18, 1992

INVENTOR(S) : Derudder, Carlos

It is certified that error appears in the above-identified patent and that said Letters Patent is hereby corrected as shown below:

On the title page, Foreign Application Priority Date, the correct number for the Belgian Application is No. 09000559.

Signed and Sealed this

Thirtieth Day of August, 1994

*Attest:*

*Attesting Officer*

Bruce Lehman

BRUCE LEHMAN

*Commissioner of Patents and Trademarks*